US011826004B2

(12) United States Patent
Reiter et al.

(10) Patent No.: US 11,826,004 B2
(45) Date of Patent: Nov. 28, 2023

(54) DISH RACK

(71) Applicant: BSH Hausgeräte GmbH, Munich (DE)

(72) Inventors: Andreas Reiter, Finningen (DE); Stefan Reiter, Winterbach (DE); Ralf Winkler, Wittislingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/782,178

(22) PCT Filed: Dec. 3, 2020

(86) PCT No.: PCT/EP2020/084407
§ 371 (c)(1),
(2) Date: Jun. 3, 2022

(87) PCT Pub. No.: WO2021/122025
PCT Pub. Date: Jun. 24, 2021

(65) Prior Publication Data

US 2023/0000307 A1 Jan. 5, 2023

(30) Foreign Application Priority Data

Dec. 19, 2019 (DE) ..... 10 2019 220 277.2

(51) Int. Cl.
*A47L 15/50* (2006.01)

(52) U.S. Cl.
CPC ..... *A47L 15/503* (2013.01)

(58) Field of Classification Search
CPC ..... A47L 15/50; A47L 15/501; A47L 15/503; A47L 15/505
USPC ..... 211/41.1–41.9
See application file for complete search history.

(56) References Cited

U.S. PATENT DOCUMENTS 5,205,419 A * 4/1993 Purtilo ..... A47L 15/505 211/151
5,480,035 A * 1/1996 Smith ..... A47L 15/503 211/168
6,571,965 B1 * 6/2003 Beck ..... A47L 15/503 211/41.8

(Continued)

FOREIGN PATENT DOCUMENTS

CN 100531665 C 8/2009
CN 104825112 A 8/2015

(Continued)

OTHER PUBLICATIONS

International Search Report PCT/EP2020/084407 dated Jan. 26, 2021.

*Primary Examiner* — Patrick D Hawn
(74) *Attorney, Agent, or Firm* — Michael E. Tschupp; Andre Pallapies; Brandon G. Braun

(57) ABSTRACT

A dish rack includes a dish basket and a storage surface which is attachable to the dish basket for holding an item to be washed and lockable on the dish basket. The storage surface is pivotable about an axis into different angles of inclination and able to slide along the axis. A support element is arranged on an underside of the storage surface and supports the storage surface at the different angles of inclination at a point spaced from the axis. The support element has a number of locking steps in which the support element engages the dish basket so as to support the storage surface at the different angles of inclination.

20 Claims, 6 Drawing Sheets

(56) References Cited

U.S. PATENT DOCUMENTS

| | | | | |
|---|---|---|---|---|
| 6,848,585 | B2 * | 2/2005 | VanLandingham | A47L 15/503 211/41.9 |
| 7,665,475 | B2 * | 2/2010 | Hedstrom | A47L 15/503 211/41.6 |
| 7,766,175 | B2 * | 8/2010 | Jadhav | A47L 15/505 211/41.9 |
| 8,757,419 | B2 * | 6/2014 | Schessl | A47L 15/505 220/489 |
| 9,131,828 | B2 * | 9/2015 | Yoon | A47L 15/503 |
| 9,615,722 | B2 * | 4/2017 | Mesa | A47L 15/50 |
| 10,165,927 | B2 * | 1/2019 | Mesa | F16B 2/22 |
| 11,006,814 | B1 * | 5/2021 | Simmonds | A47L 15/503 |
| 2005/0109378 | A1 | 5/2005 | Landsiedel | |
| 2007/0039904 | A1 * | 2/2007 | Purushothaman | A47L 15/503 211/41.8 |
| 2008/0110480 | A1 * | 5/2008 | Choi | A47L 15/503 134/135 |
| 2008/0272073 | A1 | 11/2008 | Pike | |
| 2008/0302399 | A1 | 12/2008 | Classen | |
| 2019/0290098 | A1 * | 9/2019 | Mohite | A47L 15/503 |
| 2020/0281441 | A1 * | 9/2020 | Kim | A47L 15/505 |

FOREIGN PATENT DOCUMENTS

| | | | | |
|---|---|---|---|---|
| DE | 202004021026 | U1 | 7/2006 | |
| DE | 102014226808 | A1 * | 6/2016 | A47L 15/503 |
| EP | 1665975 | A1 | 6/2006 | |
| EP | 2245975 | A1 | 11/2010 | |
| EP | 2554099 | A2 | 2/2013 | |

* cited by examiner

DISH RACK

CROSS-REFERENCES TO RELATED APPLICATIONS

This application is the U.S. National Stage of International Application No. PCT/EP2020/084407, filed Dec. 3, 2020, which designated the United States and has been published as International Publication No. WO 2021/122025 A1 and which claims the priority of German Patent Application, Serial No. 10 2019 220 277.2, filed Dec. 19, 2019, pursuant to 35 U.S.C. 119(a)-(d).

The contents of International Application No. PCT/EP2020/084407 and German Patent Application, Serial No. 10 2019 220 277.2 are incorporated herein by reference in their entireties as if fully set forth herein.

BACKGROUND OF THE INVENTION

The invention relates to a dish rack for a dishwasher, in particular a household dishwasher, having at least one dishwasher cavity, which dish rack is movably arranged in the dishwasher cavity and comprises a dish basket and a storage surface for holding items to be washed, which storage surface can be coupled to the dish basket.

The items to be washed are generally arranged in a dishwasher cavity of a dishwasher, in particular a household dishwasher, in one or more dish baskets, to which washing liquor, i.e. washing fluid and any additives such as detergent, rinse aid and the like, are applied during the cleaning process. The dish baskets of known dishwashers frequently consist of a wire mesh and are generally mounted so as to be able to slide on the side walls of the dishwasher cavity by means of rail systems, so that the dish baskets may be pulled out of the dishwasher cavity of the dishwasher. A drawback of these known dish baskets is that they have a substantially rigid wire construction which permits only limited possibilities of variation when loaded with items to be washed.

Dish baskets for dishwashers, in particular household dishwashers, which are divided into storage surfaces with special devices for the arrangement of specific dishes or cutlery are also known. In some dish baskets, the storage surfaces are pivotably fastened so that, if required, the storage surfaces may be moved into a horizontal position in which they may be provided with items to be washed or they may be moved into a vertical position in order to increase the storage space in the dish basket. These known storage areas have the drawback that they provide merely the choice of using or folding up the storage area, without increasing the possibilities of variation in the arrangement of items to be washed in the dish basket or on the storage area.

It is also known that cups have depressions in the respective bottom regions thereof, washing liquor generally collecting therein during a washing cycle of a dishwasher, in particular a household dishwasher. In the known manner, this respectively collected washing liquor unfortunately does not completely dry during the drying phase of a dishwasher. In order to counteract this formation of so-called puddles, an oblique adjustable surface is incorporated in the receiving bottom of a dish basket of a dishwasher, but this is only effective with small, in particular shallow, cups and it significantly restricts the available space when loading the dish basket of a dishwasher with large items to be washed, such as for example bowls, tall mugs and glasses and the like. In the case of large mugs and glasses, the steep elevation of the receiving bottom of the dish basket also acts negatively on the stability.

The publication EP 2 554 099 A2 discloses a dish support which is able to be positioned in a dish basket of a dishwasher having a bottom. The dish support may be positioned in the dish basket in at least two operating states so that at least one part of the bottom of the dish basket is able to adopt different configurations in each case. To this end, the dish support has an elongated shape and comprises two portions which are connected together along a central connecting line. At least one of the two portions of the dish support comprises a grid structure which comprises small bars for the purpose of a sufficient drainage of the washing liquor. The other portion of the dish support comprises a transverse piece which is arranged at right-angles to the small bars of one of the two portions of the dish support and which comprises coupling means for coupling the dish support to the bottom of the dish basket.

The publication DE 20 2004 021 026 U1 discloses a dishwasher having at least one dishwasher cavity, at least one dish basket and at least one storage element for storing items to be washed, said storage element being able to be coupled to the dish basket and comprising a storage surface. The storage element can be locked on the dish basket and can be pivoted about an axis into different angles of inclination. At least one support element which supports the storage element at a point spaced from the axis at different angles of inclination is provided.

The publication EP 2 245 975 A1 discloses a storage element which is pivotably attached to a bottom wire of a dish basket by means of a plurality of snap connections. The storage element may be pivoted between a folded-up resting position and a folded-down operating position. Moreover, the storage element has a plurality of profiled bars which have depressions and projections for securely holding items to be washed, such as for example glasses. The storage element has on the underside at least one hook element which in the folded-down operating position of the storage element is able to be latched into at least one intermediate connecting wire running perpendicular to the bottom wire. During the course of the latching of the hook element into the intermediate connecting wire, the storage element may be slid at least slightly horizontally in its folded-down operating position.

While already known dish baskets and storage elements have proved advantageous in everyday practical use, there is always the need for improvement. Thus, in particular, it is desirable to avoid as far as possible the described puddling, even in the case of larger items to be washed, to provide more loading flexibility for the consumer, to improve the drying result with an optimal use of space in the dish basket and, in particular, to achieve optimal drying, even of small items to be washed, in particular cups and the like, with at the same time improved use of space for tall items to be washed.

The term "item to be washed" is generally used in the context of this patent application for any type of item to be washed, i.e. both for crockery and for cutlery. Crockery may in turn be an item of cookware, i.e. a vessel or a device which is used for preparing meals, or an item of dinnerware, i.e. a vessel or a device which is used for serving and consuming meals. Cutlery may be a tool which is used for eating food. The cutlery common in European culture today consists of a knife, fork and spoon.

BRIEF SUMMARY OF THE INVENTION

Against this background, it is an object of the present invention to propose an improved dish rack for a dishwasher, in particular a household dishwasher.

This object is achieved by the dish rack according to the invention for a dishwasher, in particular a household dishwasher, having the features as claimed in claim 1. Advantageous developments of the present invention are specified in claims 2 to 15.

The dish rack for a dishwasher, in particular a household dishwasher, having at least one dishwasher cavity, according to the present invention is movably arranged in the dishwasher cavity and comprises a dish basket and a storage surface for holding items to be washed, which storage surface can be coupled to the dish basket. The storage surface can be locked on the dish basket, and the storage surface can be pivoted about an axis into different angles of inclination and also can be slid along the axis. Moreover, at least one support element is arranged on the underside of the storage surface, which support element supports the storage surface at different angles of inclination at a point spaced from the axis. The support element arranged on the underside of the storage surface has a number of locking steps, which come into engagement with the dish basket, whereby the storage surface is supported at different angles of inclination.

The change to the angle of inclination of the storage surface which can be locked on the dish basket is carried out according to the invention by a combined movement, i.e. by a longitudinal sliding of the storage surface along an axis and preferably a simultaneous rotation of the storage surface about the axis.

The dish rack according to the invention for a dishwasher, in particular a household dishwasher, has the advantage that the angle of inclination of the storage surface in the dish basket may be adjusted in a variable manner. As a result, the storage surface may be adapted according to the height and width of the items to be washed to be arranged thereon. Since the angle of inclination of the storage surface is able to be set according to the respective space requirement of the items to be washed, the items to be washed may be arranged in a particularly space-saving manner in the dish basket, which permits an optimal use of the space of the dish basket. Since the support element supports the storage surface at a point spaced from the pivot axis thereof, a complex mechanism for absorbing relatively large amounts of torque on the pivot axis for locking the storage surface is superfluous. Due to the simple construction of the support element, the production costs of the dish rack of the dishwasher, in particular the household dishwasher, are reduced according to the present invention.

The use of a storage surface which is variable in terms of the angle of inclination thereof promotes a more comfortable, easily accessible and secure storage of the items to be washed in the dish basket with optimal use of the available storage space. As a result, a clear arrangement of the items to be washed in specific positions in the dish basket may also be achieved and a mutual contact of the items to be washed may be prevented, which promotes the cleaning thereof and prevents damage to the items to be washed and the development of noise in the washing mode of the dishwasher, in particular the household dishwasher.

In a first embodiment according to the invention, it is provided that the locking steps are configured on the support element as supports, which act on the dish basket depending on the angle of inclination and preferably fixedly hold this dish basket by the support surface.

The locking steps, which are configured as supports on the support element, may in each case have a surface which is curved in a concave manner so that in each case they bear securely against the dish basket over a longer distance. The design of the support element with a number of locking steps facilitates the handling of the support mechanism.

In a second embodiment according to the invention, it is provided that the supports of the locking steps on the support element have an offset ranging from 1 to 10 mm, preferably from 2 to 8 mm, in particular from 3 to 6 mm.

These described offset regions permit an optimal positioning of the storage surface as a function of the dimensions of the items to be washed which are to be stored. Undesired puddling may also be effectively avoided, even in the case of larger items to be washed, and greater loading flexibility for the consumer is effectively provided. Finally, the drying result may be improved with optimal use of space in the dish basket.

In a further embodiment according to the invention, it is provided that at least two support elements are arranged so as to be preferably uniformly distributed on the underside of the storage surface.

The provision of at least two support elements ensures an improved stability, on the one hand, and an optimal positional accuracy of the storage surface, on the other hand. A uniform distribution of the at least two support elements brings about a reduced deflection of the storage surface.

In a further embodiment according to the invention, it is provided that the storage surface can be pivoted between a folded-up resting position and at least one folded-down operating position.

The folded-up resting position of the storage surface is preferably a substantially perpendicular position of the storage surface, whereas the at least one folded-down operating position is an oblique position of the storage surface below a selected angle of inclination of the storage surface. The plurality of folded-down operating positions promotes a more comfortable, easily accessible and secure storage of the items to be washed in the dish rack with optimal use of the available storage space. As a result, a clear arrangement of the items to be washed in specific positions in the dish basket may also be achieved and a mutual contact of the items to be washed may be prevented, which promotes the cleaning thereof and prevents damage to the items to be washed and the development of noise in the washing mode of the dishwasher, in particular the household dishwasher.

In a further embodiment according to the invention, it is provided that the preferably planar storage surface consists of a plurality of longitudinal elements and transverse elements, preferably made of plastic or metal.

The plurality of longitudinal elements and transverse elements of the preferably planar storage surface promotes a simple but stable construction of the storage surface. Spray shadows are effectively avoided and improved cleaning and drying performances are achieved without further effort. The longitudinal elements and transverse elements also permit as far as possible an unhindered throughflow of washing liquor through the storage surface.

In a further embodiment according to the invention, it is provided that the support surface is preferably provided in the region of the axis with a stop contour for items to be washed, which is designed in a continuous or spaced-apart manner.

The stop contour for items to be washed brings about an effective securing of the items to be washed against slippage and thus against possible damage thereto. The stop contour for items to be washed brings about an effective action, irrespective of the dimensions of the items to be washed.

In a further embodiment according to the invention, it is provided that the stop contour for items to be washed comprises round and/or polygonal stop segments.

The aforementioned shapes of the stop elements are simple and cost-effective to produce and they permit as far as possible an unhindered throughflow of washing liquor through the storage surface.

In a further embodiment according to the invention, it is provided that the storage surface is preferably releasably connected to the dish basket via a clamping connection.

The preferably releasable connection of the storage surface to the dish basket via a clamping connection ensures a secure fixing of the storage surface to the dish rack. If required, for example, the storage surface may also be detached as a whole from the dish basket for the purpose of arranging bulky items to be washed. In this case, the clamping connection may be formed between the storage surface and the dish basket, for example by correspondingly curved, preferably hook-shaped, ends of the storage surface.

In a further embodiment according to the invention, it is provided that the dish basket has a receiving bottom of the dish basket formed from a plurality of spaced-apart longitudinal elements and transverse elements and forming an adjustable surface, wherein the transverse elements are arranged perpendicular to the longitudinal elements and wherein the transverse elements are connected to the longitudinal elements at intersection points.

This design of the dish basket ensures in the known manner a high degree of stability and a desired dimensional accuracy of the dish basket.

In a further embodiment according to the invention, it is provided that the receiving bottom of the dish basket is configured in the region below the storage surface to be horizontal, approximately horizontal, or slightly inclined.

This embodiment of the receiving bottom of the dish basket in the region below the storage surface already permits an inclined rack for items to be washed, while avoiding undesired puddling and improving the drying performance.

In a further embodiment according to the invention, it is provided that a longitudinal element of the dish basket forms the axis for the storage surface and that the storage surface is preferably releasably connected to this longitudinal element of the dish basket via a clamping connection.

The use of an already present longitudinal element of the dish basket ensures a secure fixing of the storage surface to the dish basket. If required, the storage surface may also be detached as a whole from the dish basket, for example for the purpose of arranging bulky items to be washed. In this case, the clamping connection between the storage surface and the dish basket may be formed, for example, by correspondingly curved, preferably hook-shaped, ends of the storage surface.

In a further embodiment according to the invention, it is provided that the number of support elements arranged on the underside of the storage surface is equal to the number of transverse elements covered at least in some regions by the storage surface, so that a transverse element is assigned to each support element.

The provision of an equal number of support elements and transverse elements ensures an improved stability, on the one hand, and an optimal positional accuracy of the storage surface, on the other hand. Moreover, such a distribution of the support elements brings about a reduced deflection of the storage surface.

In a further embodiment according to the invention, it is provided that the dish basket has a plurality of separate, preferably adjacently arranged, storage surfaces, in each case at least one support element being assigned thereto.

Such an arrangement of separate storage surfaces permits an independent setting of different angles of inclination of separate storage surfaces and thus an optimal use of the dish basket for loading with the items to be washed. As a result, it is also possible, for example, to use a plurality of storage surfaces in the dish basket adjacent to one another, in order to accommodate a larger quantity of flat items to be washed in the dish basket, for example.

In a further embodiment according to the invention, it is provided that the storage surface and the at least one support element are produced in a uniform material, in particular by an injection-molding method.

Such a material uniformity permits a production method which is reliable in terms of process and cost-effective. It is particularly advantageous if the support element is at least partially manufactured from resilient material, in particular from plastic. As a result, the support element may be adjusted in a simple manner into the desired positions. The support element in this case is preferably pretensioned toward the storage surface with spring pretensioning, wherein the spring pretensioning may be generated either by a separate spring mechanism or by the spring force inherent in the resilient material.

Further advantageous embodiments and aspects of the dish rack for the dishwasher, in particular the household dishwasher, form the subject matter of the subclaims and the exemplary embodiments of the dish rack described hereinafter. The dish rack is described in more detail hereinafter by means of preferred embodiments with reference to the accompanying figures.

BRIEF DESCRIPTION OF THE DRAWINGS

In the figures

DETAILED DESCRIPTION OF EXEMPLARY EMBODIMENTS OF THE PRESENT INVENTION

Figure 1:
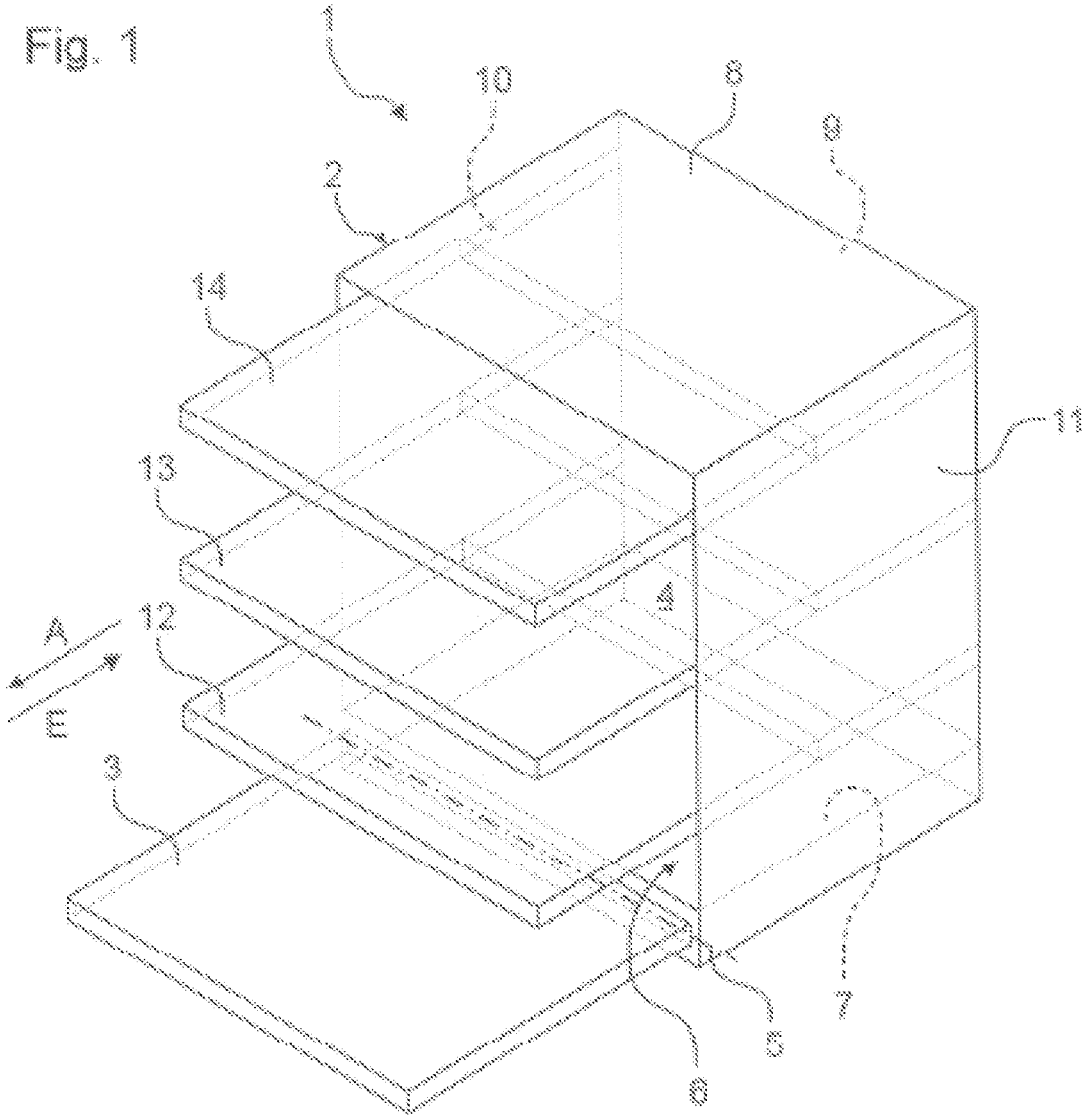
FIG. 1 shows a schematic perspective view of an embodiment of a known dishwasher, in particular a known household dishwasher.

Elements which are the same or functionally the same are provided with the same reference numerals in the figures unless indicated otherwise.

FIG. 1 shows a schematic perspective view of a household dishwasher 1, generally a dishwasher. The household dishwasher 1 has a box-shaped dishwasher cavity 2 having a front-side dishwasher cavity opening 6 for holding items to be washed which are to be cleaned. The front-side cavity opening 6 defines an opening plane 4 which is oriented, in particular, vertically.

The dishwasher cavity 2 of the household dishwasher 1 is provided with an appliance door 3 which closes the cavity opening 6 and which is pivotably mounted about a horizontal axis, so that the body may be sealed in a water-tight manner. The appliance door consists in the known manner of an inner door 3.1 and an outer door 3.2. Additionally, a furniture panel 3.3 may be attached to the outer door 3.2.

The dishwasher cavity 2 and the appliance door 3 form a washing chamber for washing items to be washed. The appliance door 3 in FIG. 1 is shown in the open position thereof. By pivoting about a pivot axis 5 provided on a lower end of the appliance door 3, the appliance door 3 may be in particular fully or partially opened and in particular fully closed.

The dishwasher cavity 2 is, for example, cuboidal and comprises a cavity bottom 7, a cavity ceiling 8 opposing the cavity bottom 7, a cavity rear wall 9 opposing the cavity door 5 and two cavity side walls 10, 11 opposing one another. The dishwasher cavity 2 may be manufactured from stainless steel, from plastic or from a stainless steel-plastic combination.

The dishwasher 1 also has at least one loading level 12 to 14. In particular a plurality of loading levels 12 to 14 may be provided, wherein a loading level 12 may be a lower dish basket (lower basket), a loading level 13 may be an upper dish basket (upper basket) and a loading level 14 may be a cutlery drawer of the dishwasher 1. The plurality of loading levels 12 to 14 are preferably arranged one above the other in the dishwasher cavity 2. Each loading level 12 to 14 is able to be selectively pushed into the dishwasher cavity 2 in a push-in direction E (arrow), in particular in a linear manner, or moved out therefrom in a pull-out direction A (arrow), in particular in a linear manner.

Figure 2A:
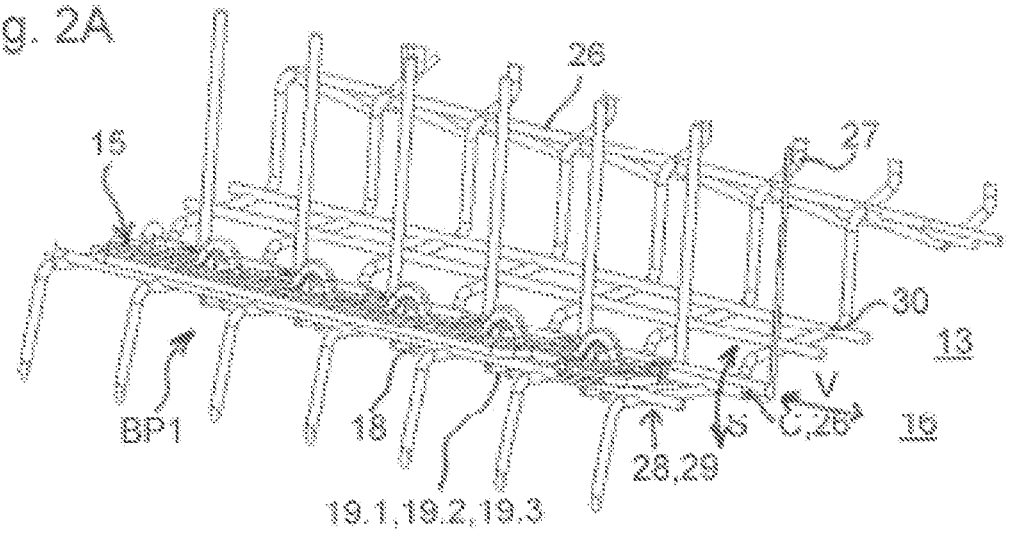
FIG. 2A shows a schematic perspective view of a preferred embodiment of a storage surface according to the invention which can be coupled to a dish basket for holding items to be washed in a first operating position.

FIG. 2A shows a schematic perspective view of a preferred embodiment of a storage surface 15 according to the invention which can be coupled to a dish basket 13 for holding items to be washed in a first operating position BP1.

The storage surface 15 can be coupled to the upper dish basket 13 shown by way of example and partially; but naturally it can be coupled to the lower dish basket, not shown, or even to the cutlery drawer, not shown. The upper dish basket 13 and the storage surface 15 are part of the dish rack 16.

Moreover, the storage surface 15 can be locked, preferably releasably connected, to the upper dish basket 13 by means of a plurality of clamping connections 17 (see FIG. 2C, FIG. 3C, FIG. 4C, FIG. 6 and FIG. 8), and can be pivoted about an axis C (see also FIG. 2C, FIG. 3C and FIG. 4C) into different angles of inclination and also can be slid along the axis C (see also FIG. 2C, FIG. 3C and FIG. 4C) (pivoting direction S (double arrow) and sliding direction V (double arrow)). The change to the angle of inclination of the storage surface 15 which can be locked on the dish basket 13 is carried out by a combined movement, i.e. by a longitudinal sliding of the storage surface 15 along the axis C (see also FIG. 2C, FIG. 3C and FIG. 4C) and preferably a simultaneous rotation of the storage surface 15 about the axis C (see also FIG. 2C, FIG. 3C and FIG. 4C). The storage area 15 is pivoted into an angle of inclination W.1 (FIG. 2C).

Figure 2B:
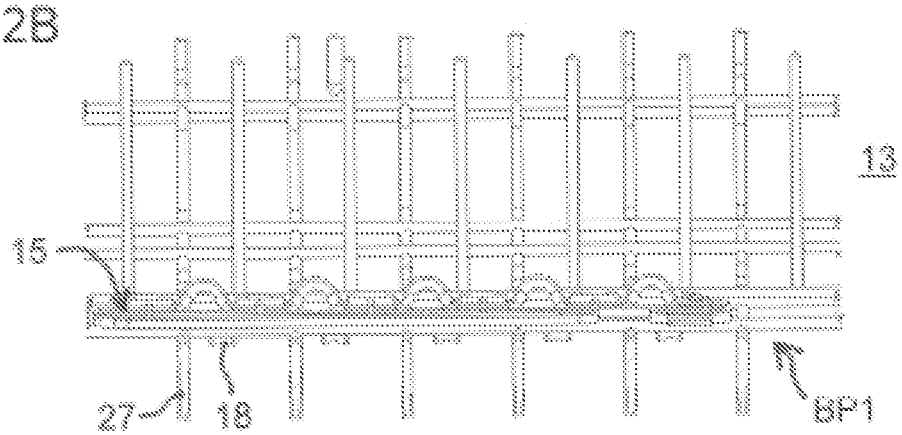
FIG. 2B shows a schematic and partial front view of the preferred embodiment of the storage surface according to the invention which can be coupled to the dish basket for holding items to be washed according to FIG. 2A in the first operating position.
Figure 2C:
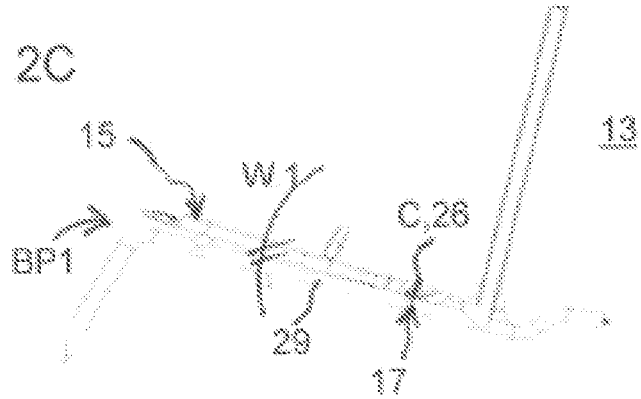
FIG. 2C shows a schematic and partial side view of the preferred embodiment of the storage surface according to the invention which can be coupled to the dish basket for holding items to be washed according to FIG. 2A in the first operating position.

A plurality of support elements 18 are arranged on the underside of the storage surface 15 (see also FIG. 5 and FIG. 7), which support the storage surface 15 at a point spaced from the axis C (see also FIG. 2C, FIG. 3C and FIG. 4C) at different angles of inclination, in the present case at an angle of inclination W.1 (FIG. 2C).

Moreover, each support element 18 arranged on the underside of the storage surface 15 has a number of locking steps 19.1, 19.2, and 19.3 (see also FIG. 5 and FIG. 7) which come into engagement with the upper dish basket 13, whereby the storage surface 15 is supported at different angles of inclination, in the present case at an angle of inclination W.1 (FIG. 2C). The storage surface 15 and the support element 18 are produced in a uniform material, in particular by an injection-molding method.

The storage surface 15 can be pivoted between a folded-up and not shown resting position, and at least one folded-down operating position BP1. According to the drawing, the storage surface 15 is pivoted by means of the locking steps 19.1 into an angle of inclination W.1 (FIG. 2C).

The upper dish basket 13 has a receiving bottom 29 formed from a plurality of spaced-apart longitudinal elements 26 and transverse elements 27 and forming an adjustable surface 28, wherein the transverse elements 27 are arranged perpendicular to the longitudinal elements 26 and wherein the transverse elements 27 are connected to the longitudinal elements 26 at intersection points 30.

The receiving bottom 29 of the dish basket 13 is configured in the region below the storage surface 15 to be horizontal, approximately horizontal or slightly inclined (see also FIG. 2C, FIG. 3C and FIG. 4C).

Figure 3A:
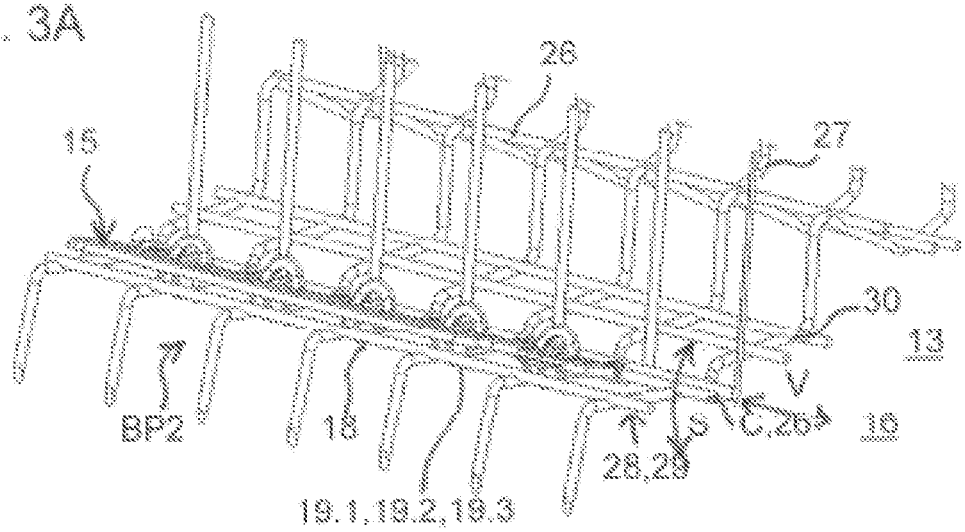
FIG. 3A shows a schematic perspective view of the preferred embodiment of the storage surface according to the invention which can be coupled to the dish basket for holding items to be washed according to FIG. 2A in a second operating position.
Figure 3B:
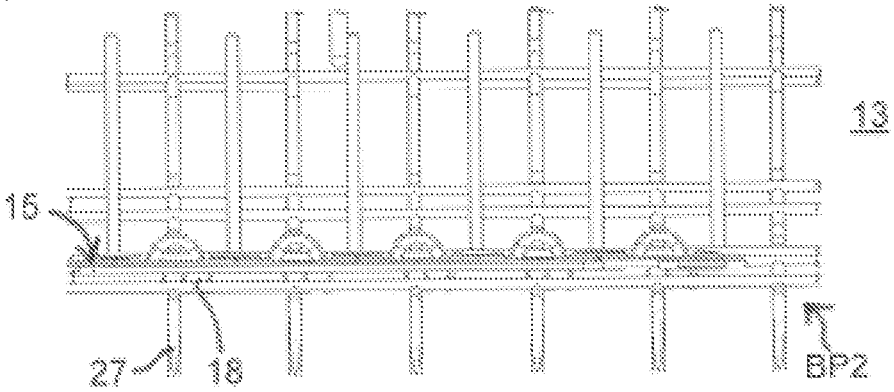
FIG. 3B shows a schematic and partial front view of the preferred embodiment of the storage surface according to the invention which can be coupled to the dish basket for holding items to be washed according to FIG. 3A in the second operating position.
Figure 3C:
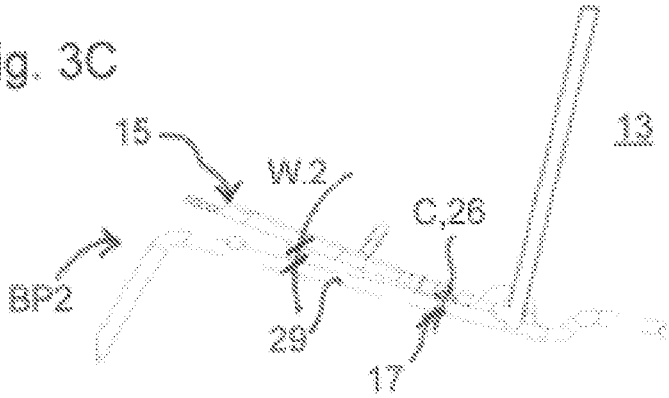
FIG. 3C shows a schematic and partial side view of the preferred embodiment of the storage surface according to the invention which can be coupled to the dish basket for holding items to be washed according to FIG. 3A in the second operating position.
Figure 4A:
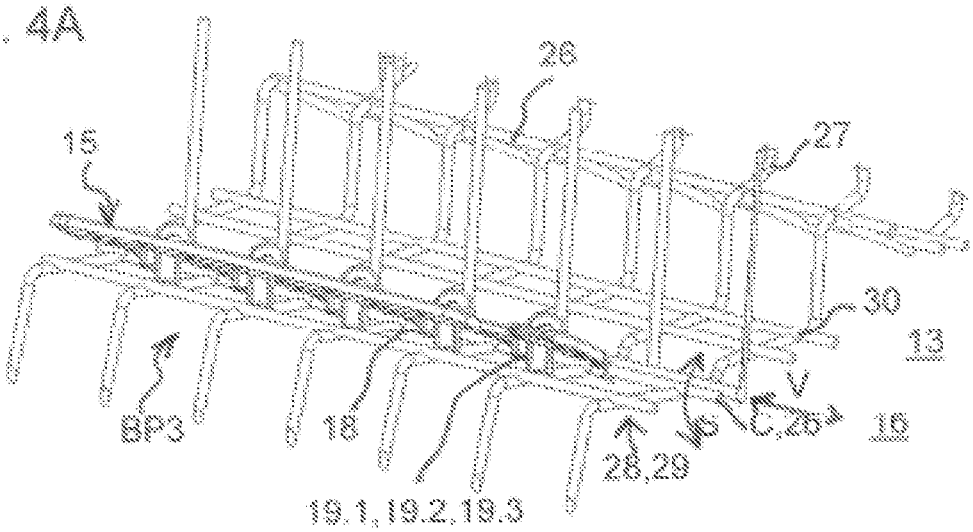
FIG. 4A shows a schematic perspective view of the preferred embodiment of the storage surface according to the invention which can be coupled to the dish basket for holding items to be washed according to FIG. 2A in a third operating position.
Figure 4B:
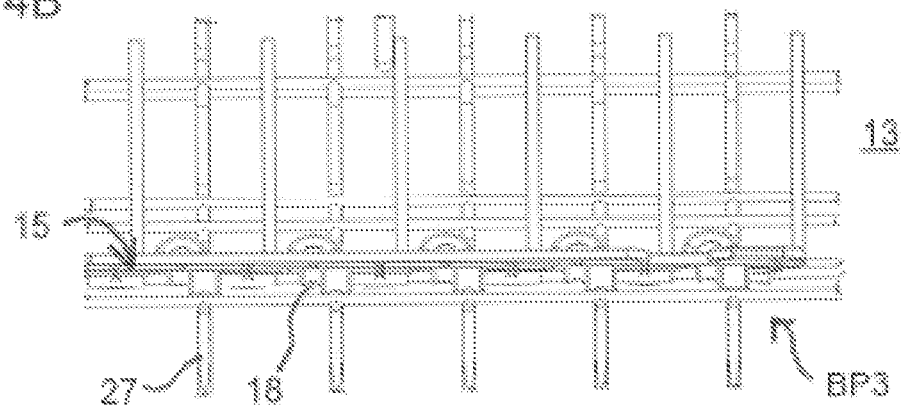
FIG. 4B shows a schematic and partial front view of the preferred embodiment of the storage surface according to the invention which can be coupled to the dish basket for holding items to be washed according to FIG. 4A in the third operating position.
Figure 4C:
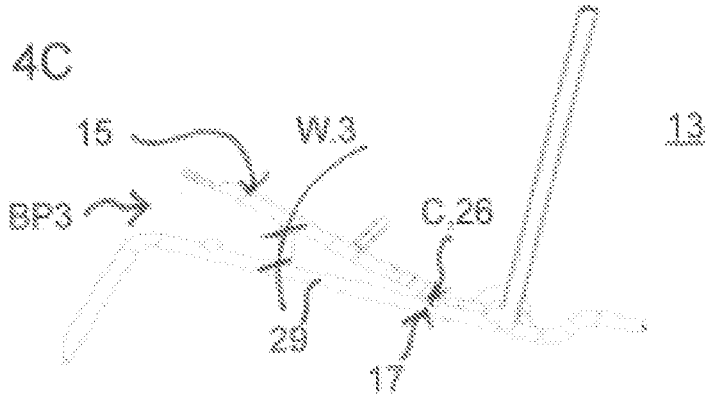
FIG. 4C shows a schematic and partial side view of the preferred embodiment of the storage surface according to the invention which can be coupled to the dish basket for holding items to be washed according to FIG. 4A in the third operating position.

A longitudinal element 26 of the dish basket 13 forms the axis C (see also FIG. 2C, FIG. 3C and FIG. 4C) for the storage surface 15 so that the storage surface 15 can be pivoted into different angles of inclination and also can be slid along the axis C (see also FIG. 2C, FIG. 3C and FIG. 4C). The storage surface 15 can be locked, preferably releasably connected, by means of a plurality of clamping connections 17 (FIG. 2C, FIG. 3C, FIG. 4C, FIG. 6 and FIG. 8) to the axis C (see also FIG. 2C, FIG. 3C and FIG. 4C).

In a manner not shown, the dish basket 13 may also have a plurality of separate, preferably adjacently arranged, storage surfaces 15, in each case at least one support element 18 being assigned thereto.

FIG. 2B shows a schematic and partial front view of the preferred embodiment of the storage surface 15 according to the invention which can be coupled to the upper dish basket 13 for holding items to be washed according to FIG. 2A in the first operating position BP1.

The number of support elements 18 arranged on the underside of the storage surface 15 is equal to the number of transverse elements 27 covered at least in some regions by the storage surface 15, so that a transverse element 27 is assigned to each support element 18 (see also FIG. 3B and FIG. 4B).

FIG. 2C shows a schematic and partial side view of the preferred embodiment of the storage surface 15 according to the invention which can be coupled to the upper dish basket 13 for holding items to be washed according to FIG. 2A in the first operating position BP1.

FIG. 3A shows a schematic perspective view of the preferred embodiment of the storage surface 15 according to the invention which can be coupled to the upper dish basket 13 for holding items to be washed according to FIG. 2A in a second operating position BP2.

The upper dish basket 13 and the storage surface 15 which can be coupled to the upper dish basket 13, shown by way of example and partially, form part of the dish rack 16.

Moreover, the storage surface 15 can be locked, preferably releasably connected, to the upper dish basket 13 by means of a plurality of clamping connections 17 (see FIG. 2C, FIG. 3C, FIG. 4C, FIG. 6 and FIG. 8), and can be pivoted about an axis C (see also FIG. 2C, FIG. 3C, and FIG. 4C) into different angles of inclination and also can be slid along the axis C (see also FIG. 2C, FIG. 3C and FIG. 4C) (pivoting direction S (double arrow) and sliding direction V (double arrow)). The change to the angle of inclination of the storage surface 15 which can be locked on the dish basket 13 is carried out by a combined movement, i.e. by a longitudinal sliding of the storage surface 15 along the axis C (see also FIG. 2C, FIG. 3C and FIG. 4C) and preferably a simultaneous rotation of the storage surface 15 about the axis C (see also FIG. 2C, FIG. 3C and FIG. 4C). The storage area 15 is pivoted into an angle of inclination W.2 (FIG. 3C).

A plurality of support elements 18 are arranged on the underside of the storage surface 15 (see also FIG. 5 and FIG. 7), which support the storage surface 15 at a point spaced from the axis C (see also FIG. 2C, FIG. 3C and FIG. 4C) at different angles of inclination, in the present case at an angle of inclination W.2 (FIG. 3C).

Moreover, each support element 18 arranged on the underside of the storage surface 15 has a number of locking steps 19.1, 19.2, 19.3 (see also FIG. 5 and FIG. 7) which come into engagement with the upper dish basket 13, whereby the storage surface 15 is supported at different angles of inclination, in the present case at an angle of inclination W.2 (FIG. 3C). The storage surface 15 and the support element 18 are produced in a uniform material, in particular by an injection-molding method.

The storage surface 15 can be pivoted between a folded-up and not shown resting position, and at least one folded-down operating position BP2. According to the drawing, the storage surface 15 is pivoted by means of the locking steps 19.2 into an angle of inclination W.2 (FIG. 3C).

The upper dish basket 13 has a receiving bottom 29 formed from a plurality of spaced-apart longitudinal elements 26 and transverse elements 27 and forming an adjustable surface 28, wherein the transverse elements 27 are arranged perpendicular to the longitudinal elements 26 and wherein the transverse elements 27 are connected to the longitudinal elements 26 at intersection points 30.

The receiving bottom 29 of the dish basket 13 is configured in the region below the storage surface 15 to be horizontal, approximately horizontal, or slightly inclined (see also FIG. 2C, FIG. 3C and FIG. 4C).

A longitudinal element 26 of the dish basket 13 forms the axis C (see also FIG. 2C, FIG. 3C and FIG. 4C) for the storage surface 15 so that the storage surface 15 can be pivoted into different angles of inclination and also can be slid along the axis C (see also FIG. 2C, FIG. 3C and FIG. 4C). The storage surface 15 can be locked, preferably releasably connected, by means of a plurality of clamping connections 17 (see FIG. 2C, FIG. 3C, FIG. 4C, FIG. 6 and FIG. 8) to the axis C (see also FIG. 2C, FIG. 3C and FIG. 4C).

In a manner not shown, the dish basket 13 may also have a plurality of separate, preferably adjacently arranged, storage surfaces 15, in each case at least one support element 18 being assigned thereto.

FIG. 3B shows a schematic and partial front view of the preferred embodiment of the storage surface 15 according to the invention which can be coupled to the upper dish basket 13 for holding items to be washed according to FIG. 3A in the second operating position BP2.

The number of support elements 18 arranged on the underside of the storage surface 15 is equal to the number of transverse elements 27 covered at least in some regions by the storage surface 15, so that a transverse element 27 is assigned to each support element 18 (see also FIG. 2B and FIG. 4B).

FIG. 3C shows a schematic and partial side view of the preferred embodiment of the storage surface 15 according to the invention which can be coupled to the upper dish basket 13 for holding items to be washed according to FIG. 3A in the second operating position BP2.

FIG. 4A shows a schematic perspective view of the preferred embodiment of the storage surface 15 according to the invention which can be coupled to the dish basket 13 for holding items to be washed according to FIG. 2A in a third operating position BP3.

The upper dish basket 13 and the storage surface 15 which can be coupled to the upper dish basket 13, shown by way of example and partially, form part of the dish rack 16.

Moreover, the storage surface 15 can be locked, preferably releasably connected, to the upper dish basket 13 by means of a plurality of clamping connections 17 (see FIG. 2C, FIG. 3C, FIG. 4C, FIG. 6 and FIG. 8), and can be pivoted about an axis C (see also FIG. 2C, FIG. 3C and FIG. 4C) into different angles of inclination and also can be slid along the axis C (see also FIG. 2C, FIG. 3C and FIG. 4C) (pivoting direction S (double arrow) and sliding direction V (double arrow)). The change to the angle of inclination of the storage surface 15 which can be locked on the dish basket 13 is carried out by a combined movement, i.e. by a longitudinal sliding of the storage surface 15 along the axis C (see also FIG. 2C, FIG. 3C and FIG. 4C) and preferably a simultaneous rotation of the storage surface 15 about the axis C (see also FIG. 2C, FIG. 3C and FIG. 4C). The storage area 15 is pivoted into an angle of inclination W.3 (FIG. 4C).

A plurality of support elements 18 are arranged on the underside of the storage surface 15 (see also FIG. 5 and FIG. 7), which supports the storage surface 15 at a point spaced from the axis C (see also FIG. 2C, FIG. 3C and FIG. 4C) at different angles of inclination, in the present case at an angle of inclination W.3 (FIG. 4C).

Moreover, each support element 18 arranged on the underside of the storage surface 15 has a number of locking steps 19.1, 19.2, 19.3 (see also FIG. 5 and FIG. 7) which come into engagement with the upper dish basket 13, whereby the storage surface 15 is supported at different angles of inclination, in the present case at an angle of inclination W.3 (FIG. 4C). The storage surface 15 and the support element 18 are produced in a uniform material, in particular by an injection-molding method.

The storage surface 15 can be pivoted between a folded-up and not shown resting position, and at least one folded-down operating position BP3. According to the drawing, the storage surface 15 is pivoted by means of the locking steps 19.3 into an angle of inclination W.3 (FIG. 4C).

The upper dish basket 13 has a receiving bottom 29 formed from a plurality of spaced-apart longitudinal elements 26 and transverse elements 27 and forming an adjustable surface 28, wherein the transverse elements 27 are arranged perpendicular to the longitudinal elements 26 and wherein the transverse elements 27 are connected to the longitudinal elements 26 at intersection points 30.

The receiving bottom 29 of the dish basket 13 is configured in the region below the storage surface 15 to be horizontal, approximately horizontal, or slightly inclined (see also FIG. 2C, FIG. 3C and FIG. 4C).

A longitudinal element 26 of the dish basket 13 forms the axis C (see also FIG. 2C, FIG. 3C and FIG. 4C) for the storage surface 15 so that the storage surface 15 can be pivoted into different angles of inclination and also can be slid along the axis C (see also FIG. 2C, FIG. 3C and FIG. 4C). The storage surface 15 can be locked, preferably releasably connected, by means of a plurality of clamping connections 17 (see FIG. 2C, FIG. 3C, FIG. 4C, FIG. 6 and FIG. 8) to the axis C (see also FIG. 2C, FIG. 3C and FIG. 4C).

In a manner not shown, the dish basket 13 may also have a plurality of separate, preferably adjacently arranged, storage surfaces 15, in each case at least one support element 18 being assigned thereto.

FIG. 4B shows a schematic and partial front view of the preferred embodiment of the storage surface 15 according to the invention which can be coupled to the upper dish basket 13 for holding items to be washed according to FIG. 4A in the third operating position BP3.

The number of support elements 18 arranged on the underside of the storage surface 15 is equal to the number of transverse elements 27 covered at least in some regions by the storage surface 15, so that a transverse element 27 is assigned to each support element 18 (see also FIG. 2B and FIG. 3B).

FIG. 4C shows a schematic and partial side view of the preferred embodiment of the storage surface 15 according to the invention which can be coupled to the upper dish basket 13 for holding items to be washed according to FIG. 4A in the third operating position BP3.

Figure 5:
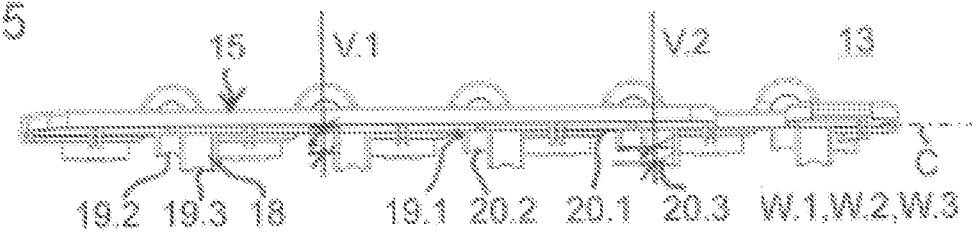
FIG. 5 shows a schematic front view of the preferred embodiment of the storage surface according to the invention which can be coupled to the dish basket for holding items to be washed according to FIG. 2A.

FIG. 5 shows a schematic front view of the preferred embodiment of the storage surface 15 according to the invention which can be coupled to the upper dish basket 13 (see also FIG. 2A to FIG. 4C) for holding items to be washed according to FIG. 2A.

A plurality of support elements 18 (see also FIG. 7) are arranged on the underside of the storage surface 15, which support the storage surface 15 at a point spaced from the axis C (see also FIG. 2A, FIG. 3A and FIG. 4A) at different angles of inclination W.1, W.2, W.3 (see FIG. 2C, FIG. 3C and FIG. 4C).

The plurality of support elements 18 arranged on the underside of the storage surface 15 are preferably uniformly distributed; but may also be arranged in at least two different spacings from one another.

Moreover, each support element 18 arranged on the underside of the storage surface 15 has a number of locking steps 19.1, 19.2, 19.3 (see also FIG. 7) which come into engagement with the upper dish basket 13 (see also FIG. 2A to FIG. 4C), whereby the storage surface 15 is supported at different angles of inclination (W.1, W.2, W.3 (see FIG. 2C, FIG. 3C and FIG. 4C). The locking steps 19.1, 19.2, 19.3 are configured on the support element 18 as supports 20.1, 20.2, 20.3 which act on the upper dish basket 13 depending on the angle of inclination W.1, W.2, W.3 (see also FIG. 2C, FIG. 3C and FIG. 4C) and preferably fixedly hold this dish basket 13 by the support surface 15.

Moreover, the supports 20.1, 20.2, 20.3 of the locking steps 19.1, 19.2, 19.3 on the respective support element 18 have an offset V.1, V.2 ranging from 1 to 10 mm, preferably from 2 to 8 mm, in particular from 3 to 6 mm. The offsets V.1, V.2 may have both equal and different values.

Figure 6:
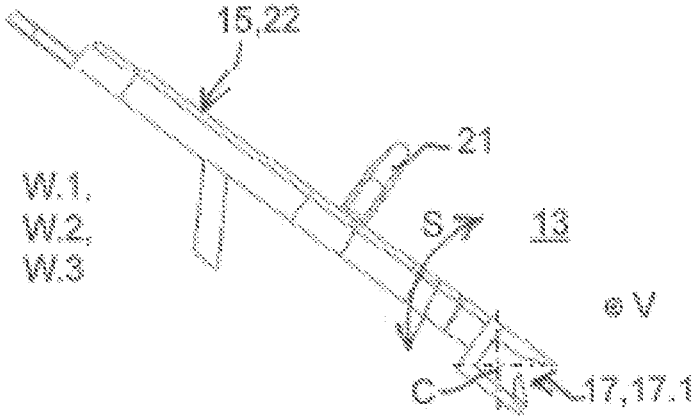
FIG. 6 shows a schematic side view of the preferred embodiment of the storage surface according to the invention which can be coupled to the dish basket for holding items to be washed according to FIG. 2A.

FIG. 6 shows a schematic side view of the preferred embodiment of the storage surface 15 according to the invention which can be coupled to the upper dish basket 13 (see also FIG. 2A to FIG. 4C) for holding items to be washed according to FIG. 2A.

The storage surface 15 can be locked, preferably releasably connected, to the upper dish basket 13 by means of a plurality of clamping connections 17 (see also FIG. 2C, FIG. 3C, FIG. 4C and FIG. 8), and can be pivoted about an axis C (see also FIG. 2C, FIG. 3C and FIG. 4C) into different angles of inclination W.1, W.2, W.3 (see also FIG. 2C, FIG. 3C and FIG. 4C) (double arrow S) and also can be slid along the axis C (see also FIG. 2C, FIG. 3C and FIG. 4C)(double arrow V). The individual clamping connection 17 may preferably be configured as a clamping hook 17.1 known to the person skilled in the art.

Moreover, the support surface 15 is preferably provided in the region of the axis C (see also FIG. 2C, FIG. 3C and FIG. 4C) with a stop contour 21 (see also FIG. 7, FIG. 8, FIGS. 9A, 9B and 9C) for items to be washed, which is designed in a continuous or spaced-apart manner.

Figure 7:
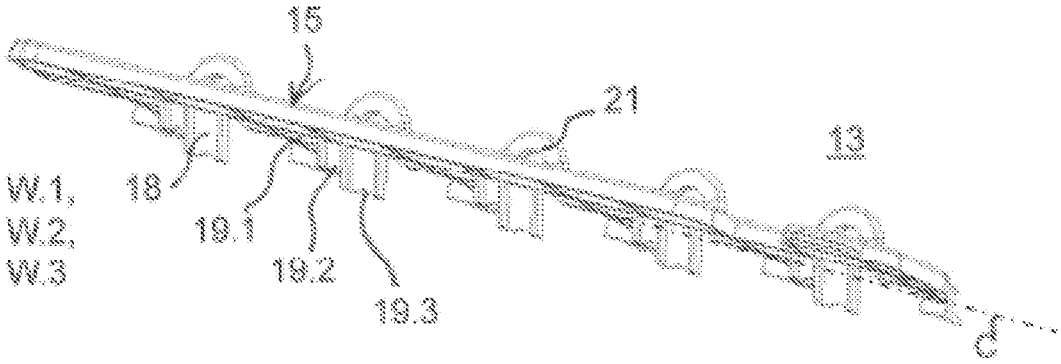
FIG. 7 shows a schematic perspective view of the preferred embodiment of the storage surface according to the invention which can be coupled to the dish basket for holding items to be washed according to FIG. 2A.

FIG. 7 shows a schematic perspective view of the preferred embodiment of the storage surface 15 according to the invention which can be coupled to the upper dish basket 13 (see also FIG. 2A to FIG. 4C) for holding items to be washed according to FIG. 2A.

A plurality of support elements 18 are arranged on the underside of the storage surface 15 (see also FIG. 5), which support the storage surface 15 at a point spaced from the axis C (see also FIG. 2C, FIG. 3C and FIG. 4C) at different angles of inclination W.1, W.2, W.3 (see FIG. 2C, FIG. 3C and FIG. 4C).

Moreover, each support element 18 arranged on the underside of the storage surface 15 has a number of locking steps 19.1, 19.2 and 19.3 (see also FIG. 5 and FIG. 7) which come into engagement with the upper dish basket 13, whereby the storage surface 15 is supported at different angles of inclination W.1, W.2, W.3 (see FIG. 2C, FIG. 3C and FIG. 4C).

Figure 8:
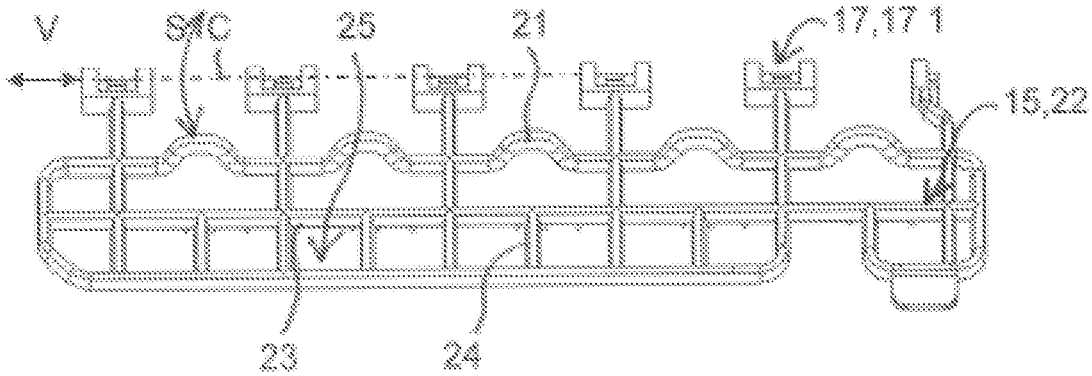
FIG. 8 shows a schematic plan view of the preferred embodiment of the storage surface according to the invention which can be coupled to the dish basket for holding items to be washed according to FIG. 2A.

FIG. 8 shows a schematic plan view of the preferred embodiment of the storage surface 15 according to the invention which can be coupled to the upper dish basket 13 (see also FIG. 2A to FIG. 4C) for holding items to be washed according to FIG. 2A.

The storage surface 15 preferably has a planar surface 22 (see also FIG. 6) and it consists of a plurality of longitudinal elements 23 and transverse elements 24, preferably made of plastic or metal. The intersecting longitudinal elements 23 and transverse elements 24 form an open grid structure 25 which ultimately forms the storage surface 15.

The storage surface 15 can be locked, preferably releasably connected, to the upper dish basket 13 by means of a plurality of clamping connections 17 (see also FIG. 2C, FIG. 3C, FIG. 4C and FIG. 6), and can be pivoted about an axis C (see also FIG. 2C, FIG. 3C and FIG. 4C) into different angles of inclination (double arrow S) and also can be slid along the axis C (see also FIG. 2C, FIG. 3C, and FIG. 4C) (double arrow V). The individual clamping connection 17 may preferably be configured as a clamping hook 17.1 known to the person skilled in the art.

Figure 9A:
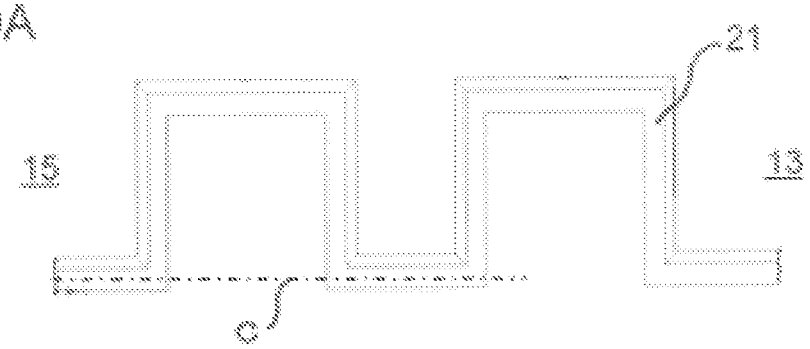
FIGS. 9A to 9C show schematic and partial front views of three further preferred embodiments of the storage surface according to the invention which can be coupled to the dish basket for holding items to be washed.
Figure 9B:
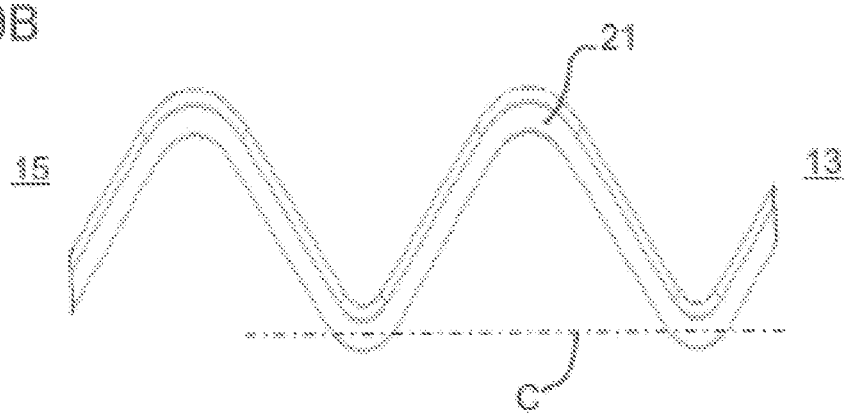
Figure 9C:
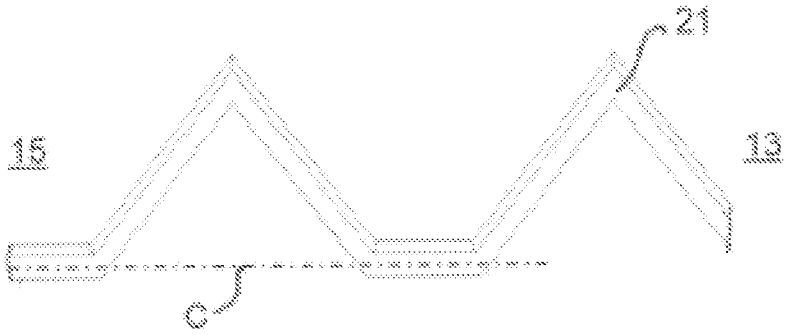

FIGS. 9A to 9C show schematic and partial front views of three further preferred embodiments of the storage surface 15 according to the invention which can be coupled to the dish basket 13 (see also FIG. 2A to FIG. 4C) for holding items to be washed.

The respective support surface 15, as already set forth, is preferably provided in the region of the axis C (see FIG. 2C, FIG. 3C and FIG. 4C) with a stop contour 21 for items to be washed, which is designed in a continuous or spaced-apart manner. With a spaced-apart embodiment, the stop contour 21 comprises a plurality of round and/or polygonal stop contour segments which are the same and which are arranged at equal or different spacings or which have an equal or approximately equal shape or different shapes.

The stop contour 21 arranged on the support surface 15 may, for example, have a rectangular contour (FIG. 9A), a wave-shaped contour (FIG. 9B) or a zig-zag contour (FIG. 9C). In principle, any contours are possible for the stop contour 21, in particular also combinations of the aforementioned contours.

While the present invention has been described with reference to exemplary embodiments, it may be modified in many different ways.

The invention claimed is:

1. A dish rack movably arranged in a dishwasher cavity of a dishwasher, said dish rack comprising:

a dish basket having a receiving bottom;

a storage surface attachable to the dish basket for holding an item to be washed and lockable on the dish basket, said storage surface being configured for pivoting about an axis into different angles of inclination, and said storage surface being configured for linearly sliding along the axis to change an angle of inclination of the storage surface; and a support element arranged on an underside of the storage surface and configured to contact the receiving bottom at one or more locations that are spaced apart from the axis to support the storage surface, said support element having a plurality of locking steps in which the support element engages the receiving bottom of the dish basket so as to support the storage surface at the different angles of inclination, wherein each locking step of the plurality of locking steps is configured to hold the storage surface at a different angle of inclination than at least one other locking step.

2. The dish rack of claim 1, wherein the supports of the locking steps on the support element have an offset ranging from 1 mm to 10 mm.

3. The dish rack of claim 1, wherein at least two of said support element are arranged on the underside of the storage surface.

4. The dish rack of claim 3, wherein the at least two of said support element are arranged uniformly distributed on the underside of the storage surface.

5. The dish rack of claim 1, wherein the storage surface is pivotable between a folded-up resting position and a folded-down operating position.

6. The dish rack of claim 1, wherein the storage surface includes a plurality of longitudinal elements and transverse segments.

7. The dish rack of claim 1, wherein the storage surface is planar.

8. The dish rack of claim 6, wherein the longitudinal elements and transverse segments are made of plastic or metal.

9. The dish rack of claim 1, wherein the storage surface is provided in a region of the axis with a stop contour for the item to be washed, said stop contour being designed in a continuous or spaced-apart manner.

10. The dish rack of claim 9, wherein the stop contour comprises round and/or polygonal stop segments.

11. The dish rack of claim 1, wherein the storage surface is releasably connected to the dish basket via a clamping connection.

12. The dish rack of claim 11, wherein the clamping connection comprises a clamping hook.

13. The dish rack of claim 1, wherein the receiving bottom is formed from a plurality of spaced-apart longitudinal elements and transverse elements, said transverse elements being arranged perpendicular to the longitudinal elements and connected to the longitudinal elements at intersection points.

14. The dish rack of claim 13, wherein the receiving bottom of the dish basket is configured in a region below the storage surface to extend horizontal, approximately horizontal, or inclined.

15. The dish rack of claim 13, wherein one of the longitudinal elements of the dish basket forms the axis for the storage surface, said storage surface being connected to the one of the longitudinal elements of the dish basket via a clamping connection.

16. The dish rack of claim 15, wherein the storage surface is releasably connected to the one of the longitudinal elements of the dish basket via the clamping connection.

17. The dish rack of claim 14, wherein a plurality of said support element are arranged on the underside of the storage surface at a number which is equal to a number of the transverse elements covered in at least one region by the storage surface, so that the transverse elements are assigned to the support elements in one-to-one correspondence.

18. The dish rack of claim 13, further comprising a plurality of said storage surface and a plurality of said support elements, wherein the number of support elements arranged on the underside of each storage surface is equal to a number of transverse elements covered in at least one region by each storage surface, so that the transverse elements are assigned to the support elements in one-to-one correspondence.

19. The dish rack of claim 18, wherein the storage surfaces are arranged adjacent to one another.

20. The dish rack of claim 1, wherein the storage surface and the support element are produced in a uniform material, in particular by an injection-molding method.

* * * * *